US006533150B1

(12) United States Patent
Margo et al.

(10) Patent No.: US 6,533,150 B1
(45) Date of Patent: Mar. 18, 2003

(54) MULTIPURPOSE ADJUSTABLE PORTABLE CARRY POUCH

(76) Inventors: Philip Frederick Margo, 140 S. Almont Dr., Beverly Hills, CA (US) 90211-2505; Joshua M Ginsberg-Margo, 3651 S. Quebec St., Denver, CO (US) 80237

( * ) Notice: Subject to any disclaimer, the term of this patent is extended or adjusted under 35 U.S.C. 154(b) by 0 days.

(21) Appl. No.: 09/709,836

(22) Filed: Nov. 9, 2000

Related U.S. Application Data

(60) Provisional application No. 60/164,476, filed on Nov. 10, 1999.

(51) Int. Cl.[7] ..... A45F 5/00

(52) U.S. Cl. ..... 224/250; 224/148.1; 224/148.4; 224/148.5; 224/269

(58) Field of Search ..... 224/250, 148.1, 224/148.5, 148.6, 254, 901, 901.2, 901.4, 901.6, 901.8, 269; D3/202, 212, 215, 218, 226; 215/12.1

(56) References Cited

U.S. PATENT DOCUMENTS 4,420,104 A * 12/1983 Dilenno ..... 224/250
4,838,466 A * 6/1989 Holmstrom ..... 224/250
5,174,483 A * 12/1992 Moore et al. ..... 224/250
5,325,991 A * 7/1994 Williams ..... 215/12.1
5,381,922 A * 1/1995 Gladman et al. ..... 224/148.5
5,535,928 A * 7/1996 Herring ..... 224/250
D378,440 S * 3/1997 Collette ..... D27/142
6,032,841 A * 3/2000 Johnson ..... 224/148.6

* cited by examiner

*Primary Examiner*—Stephen K. Cronin
*Assistant Examiner*—Maerena Brevard

(57) ABSTRACT

An adjustable carrying pouch adapted to carry devices of varying sizes. A substantially rectangular pliable horizontal segment is integral with a vertical pliable segment. The horizontal segment includes a pair of retention flaps having a central segment disposed therebetween. The vertical segment depends from the central segment. Hook fastening members are secured to the inside surface of the horizontal segment at each retention flap. The hook fastening members are secured to the inside surface of the vertical segment in opposition to the central segment. Loop fastening members are secured to the outside surface of the horizontal segment at each retention flap in opposition to the hook fastening members. A belt loop or clip is mounted along the central segment on the outside surface of the horizontal segment. The hook and loop fastening members may be adjustably coupled to adapt to the size of the device to be carried.

1 Claim, 19 Drawing Sheets

FIGURE 13
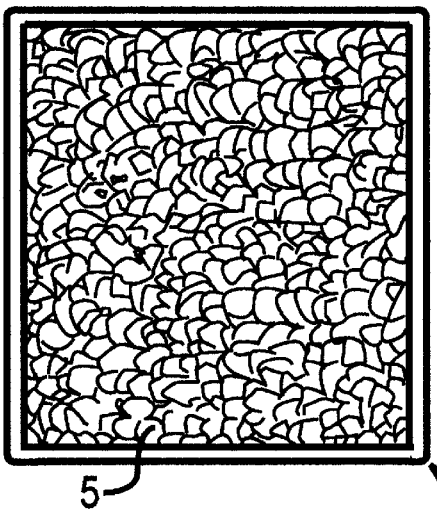
FIGURE 14
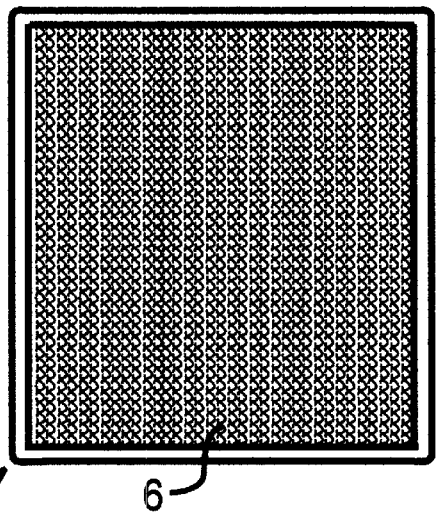
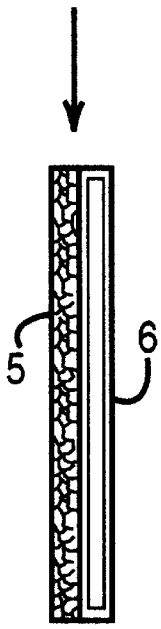
FIGURE 15

MULTIPURPOSE ADJUSTABLE PORTABLE CARRY POUCH

This application claims the benefit of Provisional application Ser. No. 60/164,476, filed Nov. 10, 1999.

BACKGROUND—Field of Invention

This invention relates to belt and clip-on style pouch assemblies specifically those that employ hook and loop component fastening systems and are utilized to carry comfortably and conveniently on one's person a wide variety of items. The carried items would include but not be limited to: baby bottles to feed newborns, infants and toddlers, water bottles, cellular and portable telephones, PDA's (Personal Desktop Assistants), a multiplicity of cameras, portable radios, video and audio remote controls, assorted tools, sunglasses, eyeglasses and wallets.

BACKGROUND—Description of Prior Art

The technological revolution is bringing with it a wide range of portable devices. Cellular and portable phones, disposable cameras, TV remotes, PDA's, CD players and mini TVs. Also there is a requirement to carry articles such as glasses, water bottles, wallets and various beverages in aluminum cans. The majority of these items have physical dimensions that would prohibit carrying them in one's pockets. Also there are many aspects of our lives that can distract attention away from crucial tasks. Caring for a newborn or infant is one such task and any distraction may result in injury or even worse. Easy and quick access to a baby bottle for feeding is an important and primary function. The ability to keep the baby bottle on one's person while standing, walking or sitting during the feeding process would be a great asset to the parent or caregiver. Also since caring for a newborn or infant requires multi-tasking, it is important that the caregiver have as little distractions as possible and not have to be concerned about placing the bottle down some where and then having to get up to look for it and retrieve it.

The Multipurpose, Adjustable, Portable Carry Pouch provides a solid, durable platform to securely support, transport and keep within easy reach, baby bottles of varying sizes, water bottles up to a quart and articles such as cell phones, portable phones, radios, PDA's and many other such items. The invention affords the parent or caregiver a lightweight carrier for the bottle so as to enable him or her to deal with the other tasks of baby care. These can include diapering, burping or just holding the baby. The device also affords the user of multiple portable electronics devices a one size fits-all option. The Multipurpose Adjustable, Portable Carry Pouch is an invention to help parents and caregivers focus on the needs of the child and the many tasks associated with those needs. Feeding is a complex process usually involving supporting the infant, holding the bottle, and burping the child. The invention allows the feeder to quickly place a bottle of any size securely into a lightweight and pliable holder attached to their waist or any other convenient location on their person rather than put the bottle down. This permits one hand to become free almost instantaneously and the bottle to remain within convenient reach at all times. The alterable design of the item also allows it to be adjusted to fit a multitude of objects from PDA's to television remotes. Although there are some products have belt pouches included this invention is a universal item that can instantly adjust accommodate a large class of transportable items and not have to switch carrying cases to do so. It is more convenient to manipulate than the other disclosures because its operation is limited to a minimum amount of steps to secure an object whether it is on or off one's person.

The Multipurpose, Adjustable, Portable Carry Pouch is an invention designed to clip or slip on in seconds to one's belt or waistband or any other convenient part of a person's clothing. The present disclosure is designed to carry the aforementioned items conveniently, comfortably, inexpensively and with unencumbered access regarding removal and replacement of said articles.

There have been varied attempts at creating multi-article carriers disclosed. However, they are mainly either more complicated in their manufacture and use; limited in their flexibility as to the vicissitude of items that can be carried; and less sturdy than the present invention. The majority of the prior art in this genre is more an arrangement of straps than a carrying case. They have the appearance and function of cargo netting rather than a secure pouch. None are made with laminated ballistic nylon so as to provide ample rigidity, which would allow them to retain their shape and not collapse when an item is removed. Having a solid but pliable fabric and a dual functional framework as opposed to merely an arrangement of straps makes it more convenient to withdraw and replace various items as in the present invention, the multipurpose, adjustable, portable, carry pouch.

Several types of multi-article carriers have been proposed. For example, Minckler, U.S. Pat. No. 6,6056,174 Compact CD player Holster. This disclosure is non-rigid and its main object is to carry only portable CD players. Green, U.S. Pat. No. 5,941,434 lacks the simplicity of manufacture requiring far more parts then the present disclosure. The central support backing must be fabricated out of either metal, plastic, leather or wood making the disclosure far more expensive and involved to produce than my invention. Further, the practical operation is more labor intensive, less user friendly and limited in its carry options. Story, Jr. U.S. Pat. No. 5,622,346 Collapsible Container Holder is limited to containers and the strap type construction will not hold its shape when an item is removed so as to allow the item to be replaced in one move with little effort. Also, to accommodate larger articles an additional cross strap must be utilized thereby further decreasing simplicity of operation. Herring, U.S. Pat. No. 5,535,928 Belt Supportable Carrier For Portable Articles has multiple straps and requires the user to thread one strap through a fixed loop and then attach the hook and loop fastener arrangement so as to secure the item to be carried. In another disclosed embodiment there is a second strap and loop assembly added giving a limited carry option but the loops are fixed and the user is restricted to only those items which will fit in the limited transporting area. Further, the strap construction will not retain its shape when the item is removed which will require additional unthreading and re-threading the straps back through the fixed loops. Moore, U.S. Pat. No. 5,174,483 Radiowrap. This invention is limited to carrying radiophones and is simply not substantial enough to carry a wide variety of items. Dilenno, U.S. Pat. No. 4,420,104, Universal Carrying Case. This invention as disclosed is designed for use as a "carrier for transporting mobile communications equipment, or the like." Its flexible tape strap construction makes it inadequate to support most other items limiting its universality especially considering smaller articles such as eyeglasses or cellular phones. The strap construction is flimsy and provides a limited holding strength, which will result in large gaps where items can slip through. To avoid this flaw, multiple straps must be utilized to properly support multidimensional devices to be carried that the present disclosure achieves by being more substantial in structure, shape, and materials and a more utilitarian design requiring fewer steps in its operation. Also, as a consequence of the use of strap-like material this invention will not hold its shape when an item is removed for use thereby negating a single-step replacement of the item. This is especially true if the chosen use is to carry a baby bottle, which must be removed and replaced at multiple intervals during the feeding process. Capano, 2,547,620, Holder for A Pack of Cigarettes. This invention is limited in use and scope to cigarettes, matches and a comb. All the universal carrying cases heretofore known suffer from a number of disadvantages:

(a) None of the preceding disclosures can accommodate the wide range of diverse articles that the present disclosure can accommodate.

(b) None of the preceding disclosures are constructed with a material that will retain its rigidity and shape making it convenient to remove and replace articles carried and yet having pliability so the user will remain comfortable and endure no physical imposition as a consequence of its use.

(c) None of the preceding disclosures are constructed with a material that can conform to the varied contours of the objects being carried.

(d) None of the preceding disclosures are constructed with enough dimension and rigidity to securely support and carry, without further reconfiguration, the wide variety of articles that my invention will support and carry.

(e) None of the preceding disclosures can carry the wide variety of articles that the present disclosure can carry without requiring multiple steps in reconfiguration to do so.

(f) None of the preceding disclosures are as simple to operate as the present disclosures that are by their design more work intensive and thereby being less convenient to operate.

(g) None of the preceding disclosures are laminated inside with a soft, brushed cotton-polyester material so as to avoid scratching or damaging more fragile articles such as the lenses of eyeglasses, sunglasses and cameras.

(h) None of the preceding disclosures can be adapted to a capacity expansion pad so as to enable a substantial augmentation in the cubic volume that the invention can contain including CD players, pocket books and the like.

(i) None of the preceding disclosures require only a simple three-step operation to use.

(j) None of the preceding disclosures utilize the hook and loop fastening systems as framework to enhance their structural rigidity.

(k) None of the preceding disclosures can adjust instantly to the circumference of a wide range of diverse articles.

(l) None of the preceding disclosures can adjust instantly to the length of a wide range of diverse articles.

(m) None of the preceding disclosures can adjust instantly to the width of a wide range of diverse articles.

(n) None of the preceding disclosures can carry a wide range of diverse articles retain its shape and store flat.

SUMMARY OF THE INVENTION

A multipurpose adjustable, portable carry pouch for carrying a wide range of diverse articles including baby bottles, a variety electronic devices, eyeglasses, sunglasses, disposable cameras, wallets and numerous other items. Due to its design and construction the present disclosure, though pliable, stays firm when objects are removed so that they may be replaced easily. The invention is formed out of soft textile-laminated ballistic nylon material fabricated into a single piece containing a horizontal segment and a vertical segment. The horizontal segment is divided into three equal sections having one retention flap on each opposing end and a central segment. The vertical tongue segment extends in a perpendicular manner outward from the center section of the horizontal segment. The retention flaps are layered with a fillet of the loop component of a hook and loop fastening system inside and out. The vertical tongue segment is layered half way up from the bottom edge fillet of the hook component from a hook and loop fastening system. The hook and loop components also function as structural framework members to assure rigidity. The disclosure also contains a belt loop, stitched or riveted onto the center section between the loop components of the hook and loop fastening system and a belt clip is affixed onto the belt loop. The borders of the present disclosure are edged with gross grain ribbon that is stitched on. The retention flaps are wrapped around or adjusted to the article to be carried and the abutting hook and loop components are mated. The vertical tongue is adjusted to the desired length and then rotated so that the hook component on the vertical tongue will engage the exposed loop component on the retention flap thereby forming the multipurpose, adjustable, portable carry pouch disclosed herein.

Objects and Advantages

Accordingly, besides the objects and advantages of the multipurpose, adjustable, portable, carry pouch in the above patent, several objects and advantages of the present invention are:

(a) to provide a Multipurpose Adjustable, Portable Carry Pouch that contains adjustable components with ample motility so as to be alterable by the manipulation of hook and loop components to securely accommodate the widest variety of items.

(b) to provide a Multipurpose Adjustable, Portable Carry Pouch that contains adjustable components with ample motility so as to be alterable by the manipulation of hook and loop components enabling it to securely accommodate the varying circumferences of the range of bottles or objects carried.

(c) to provide a Multipurpose Adjustable, Portable Carry Pouch that contains adjustable components with ample motility so as to be alterable by the manipulation of hook and loop components enabling it to securely accommodate the varying lengths of the range of bottles or objects used.

(d) to provide a Multipurpose Adjustable, Portable Carry Pouch that contains adjustable components with ample motility so as to be alterable and to be rigid enough by also using the hook and loop components as structural members to enable carried items to be conveniently removed and replaced.

(e) to provide a Multipurpose Adjustable, Portable Carry Pouch that is sturdy and has the pliability to conform to the shape of the object carried.

(f) to provide a Multipurpose Adjustable, Portable Carry Pouch that contains adjustable components with ample motility so as to be securely and easily attached to various parts of a person's clothing such as a belt waistband, shoulder strap or pocket.

(g) to provide a Multipurpose Adjustable, Portable Carry Pouch that contains adjustable components with ample motility so as to be alterable and extremely light weight.

(h) to provide a Multipurpose Adjustable, Portable Carry Pouch that can conveniently clip or slide onto a belt or clipped onto a waist band or any convenient place on one's person.

(i) to provide a Multipurpose Adjustable, Portable Carry Pouch sufficient malleability so as to cause no physical imposition on the user either when walking, standing or seated.

(j) to provide a Multipurpose Adjustable, Portable Carry Pouch designed and constructed so that the softer loop components of the hook and loop fastening system face outward and hook components of the hook and loop fastening system face inward so as not to scratch or otherwise irritate the user.

(k) to provide a Multipurpose Adjustable, Portable Carry Pouch that can be configured in a flat mode so as to be easily stored and transported.

(l) to provide a Multipurpose Adjustable, Portable Carry Pouch that is foldable for convenient storage and transport.

(m) to provide a Multipurpose Adjustable, Portable Carry Pouch that can be manufactured using laminated ballistic nylon with multiple color or fabric thickness options.

(n) to provide a Multipurpose Adjustable, Portable Carry Pouch that is conveniently operated whether the user is left or right-handed.

(o) to provide a Multipurpose Adjustable, Portable Carry Pouch that is laminated with a soft textile so as to protect the fragile components of items such as eyeglasses, sunglasses, cameras or wallets.

to provide a Multipurpose, Adjustable, Portable Carry Pouch that onto which a one piece Capacity Expansion Pad can be simple installed to allow additional larger, wider items such as CD players and paperback books to be carried.

DRAWING FIGURES

FIG. 13 shows the hook side view of the Capacity Extension Pad (CEP).

FIG. 14 shows the loop side view of the Capacity Extension Pad.

FIG. 15 shows the side view of the Capacity Extension Pad

REFERENCE NUMERALS IN DRAWINGS

Figure 1:
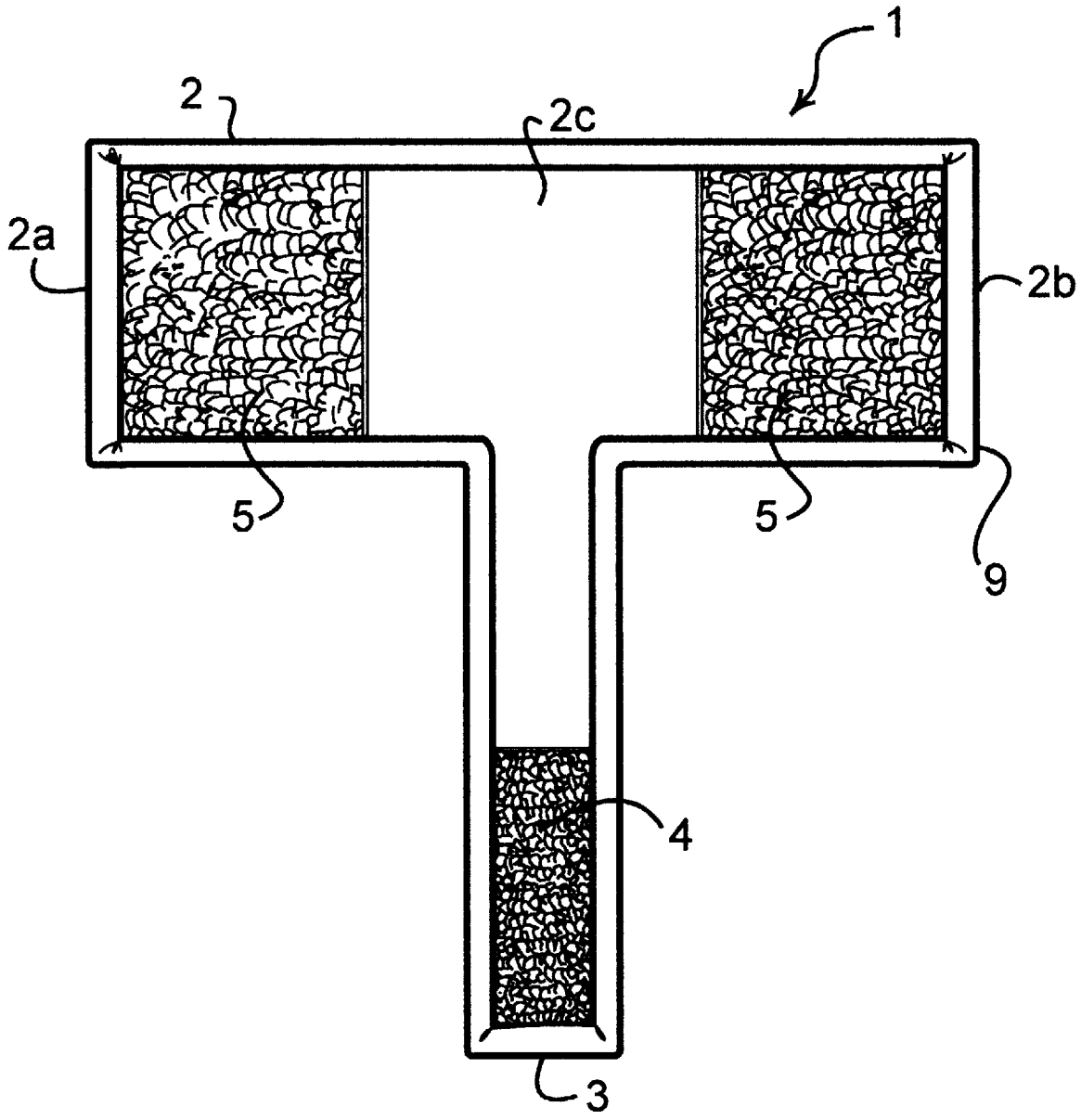
FIG. 1 shows the inside surface view of invention in the pre-acquisition mode.

1 present invention
2 horizontal segment
2*a* retention flap
2*b* retention Flap
2*c* central section
3 vertical tongue segment
4 hook components of a hook and loop fastening system
5 hook components of a hook and loop fastening system
6 loop components of a hook and loop fastening system
7 laminated ballistic nylon belt loop
8 belt clip
9 gross grain ribbon border
10 capacity extension pad (CEP)
11 belt
12 thermos
13 belt
14 water bottle
15 cellular phone
16 PDA
17 baby bottle
1A alternate embodiment of the present invention
18 belt loop extension wing
19 hook components of a hook and loop fastening system
20 hook components of a hook and loop fastening system
21 loop components of a hook and loop fastening system

DESCRIPTION—FIGS. 1–18—Preferred Embodiment

Figure 2:
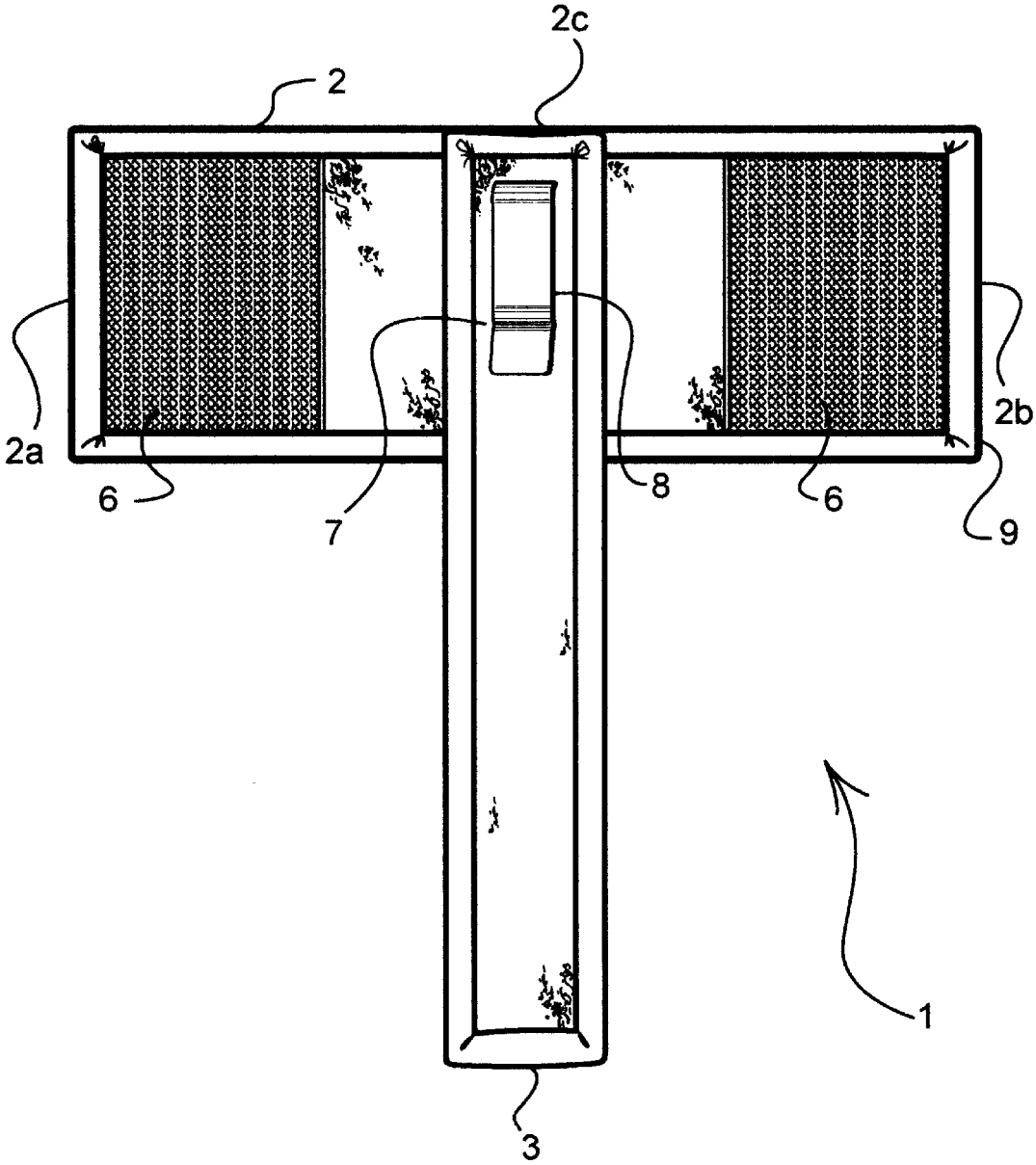
FIG. 2 shows the outside surface view of the present invention in the pre-acquisition mode.
Figure 3:
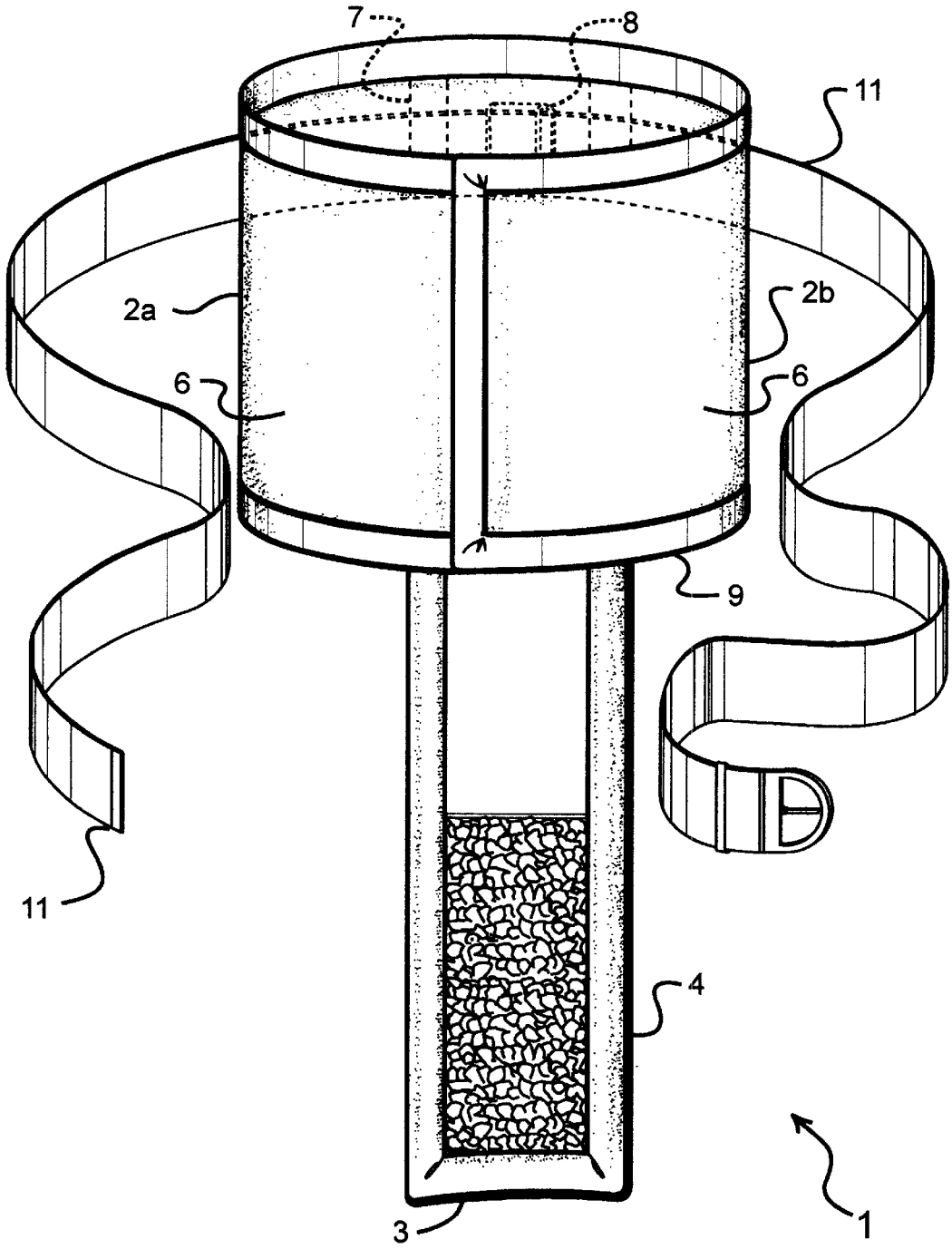
FIG. 3 shows the top-front view of the present invention in the partially engaged mode with belt threaded through belt clip.
Figure 4:
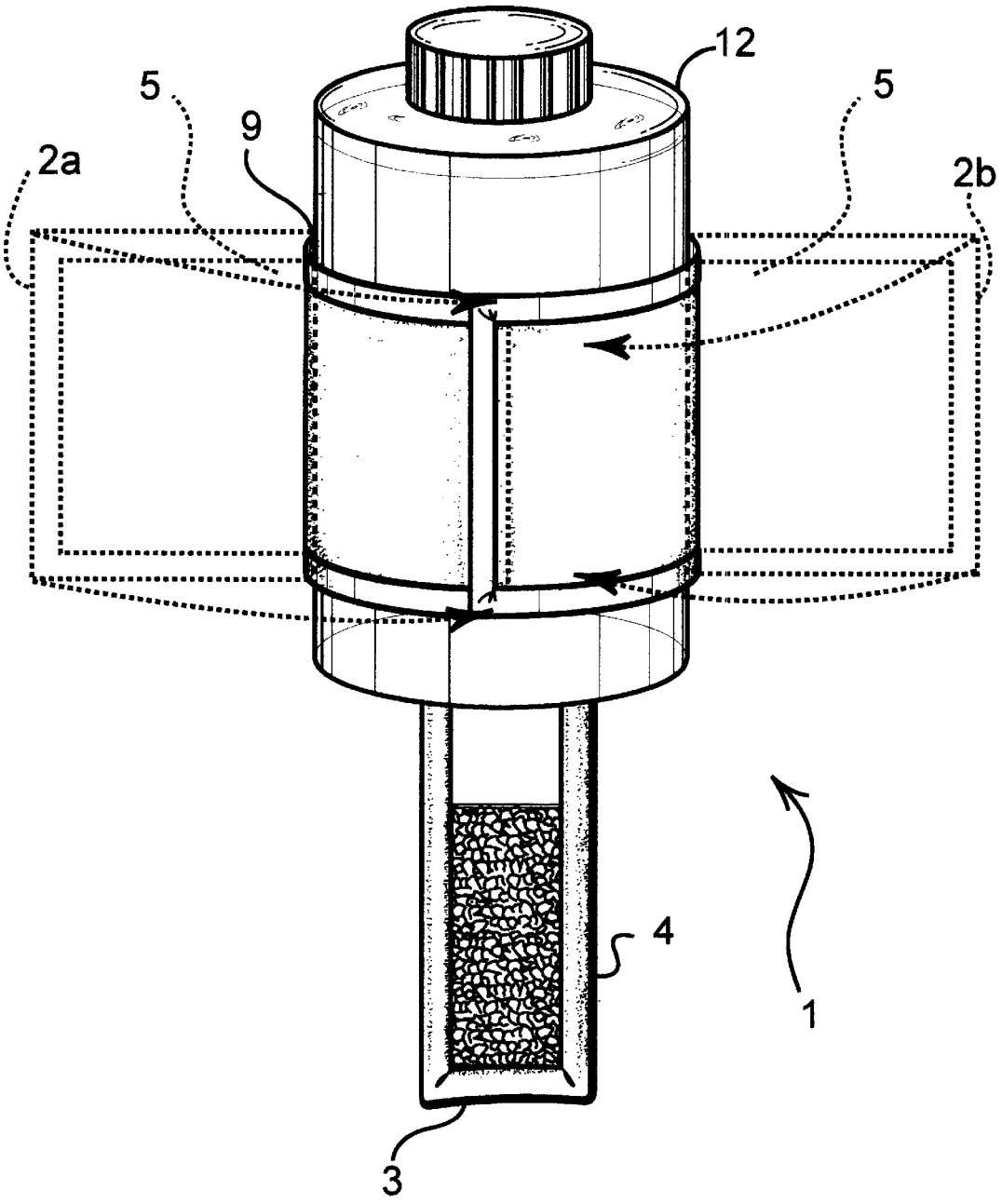
FIG. 4 shows the bottom front view of the present invention in the partially engaged mode carrying thermos. Open retention flaps are shown in phantom.
Figure 5:
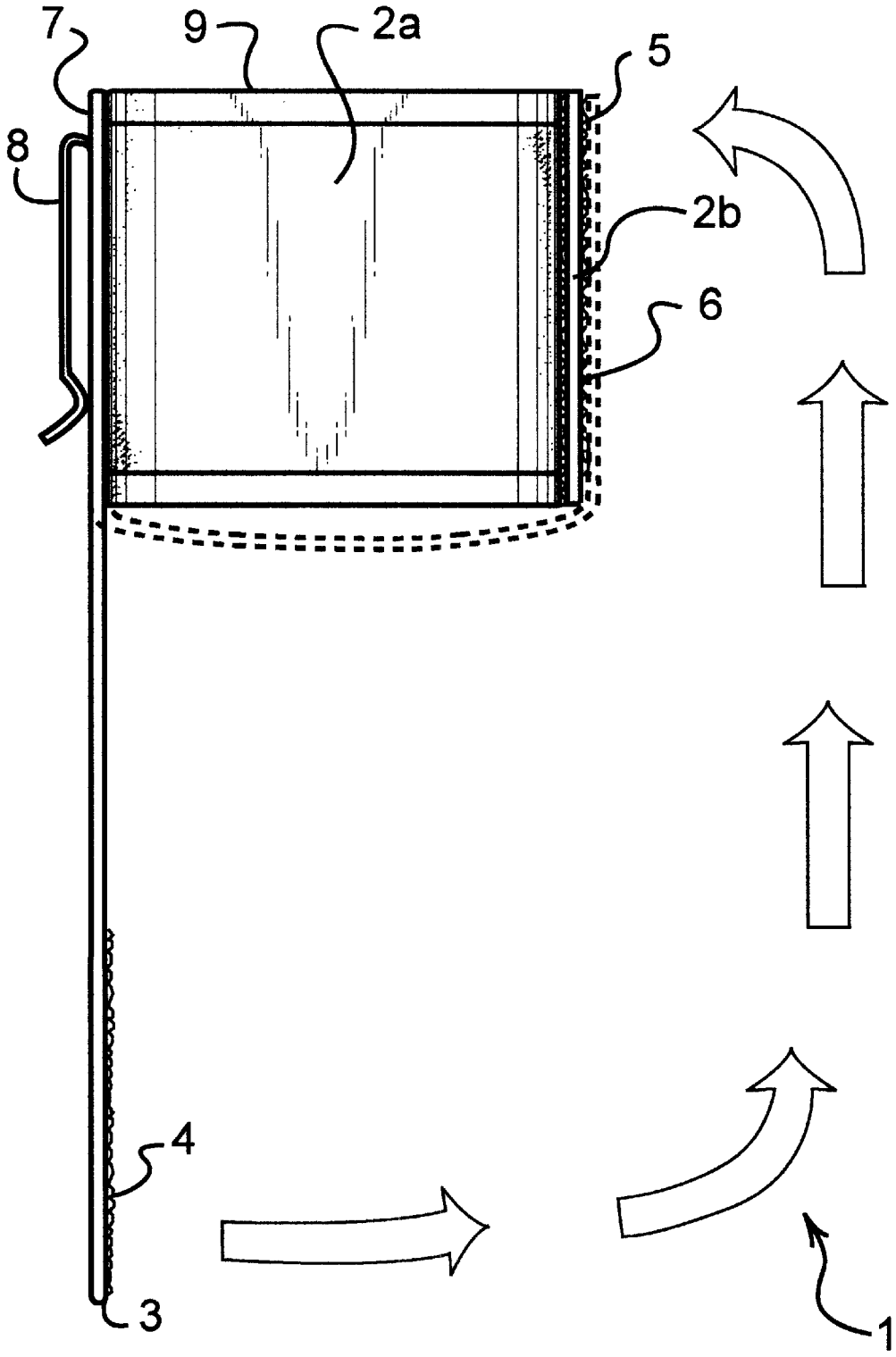
FIG. 5 shows the side view of the present invention from the acquisition to the engaged modes.
Figure 6:
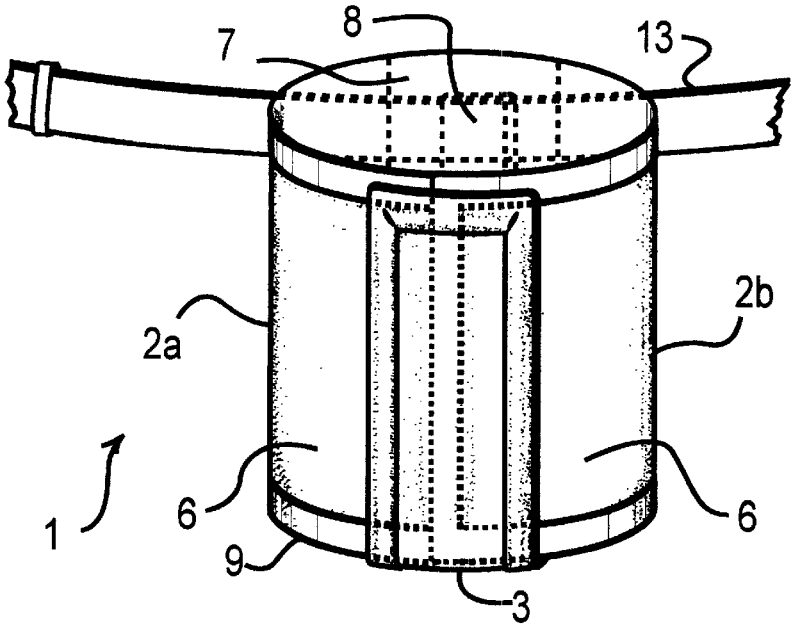
FIG. 6 shows the top-front view of the present invention in the engaged mode clipped on belt.
Figure 7:
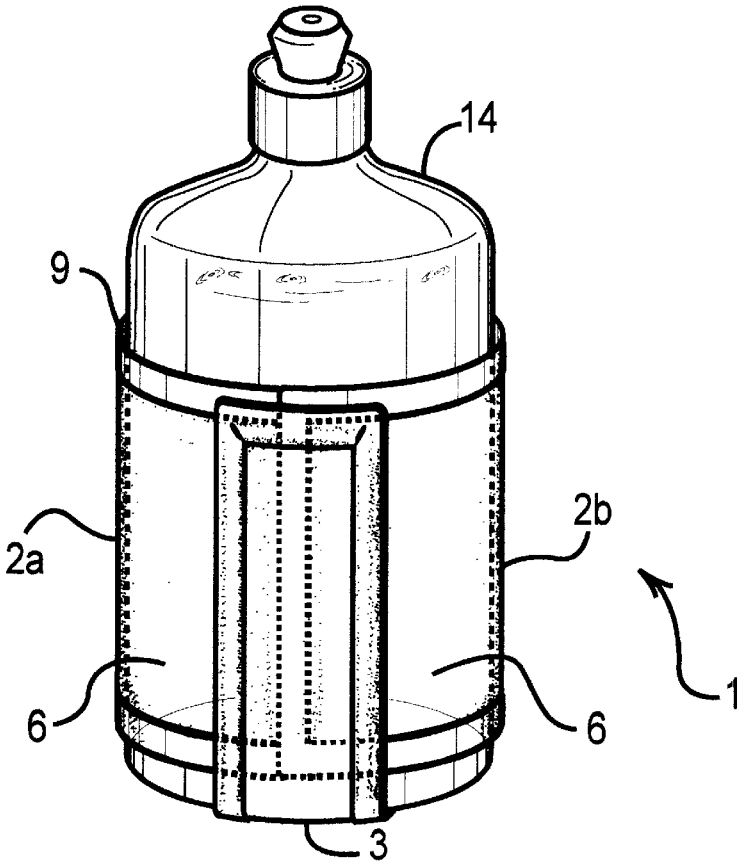
FIG. 7 shows the bottom front view of the present invention in the engaged mode carrying water bottle.
Figure 8:
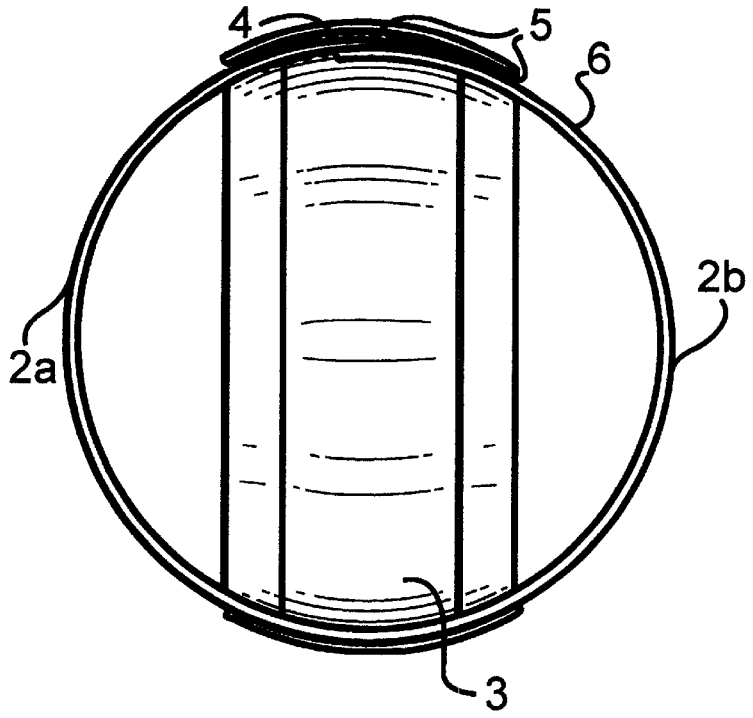
FIG. 8 shows the top view of the present invention in the engaged mode.
Figure 9:
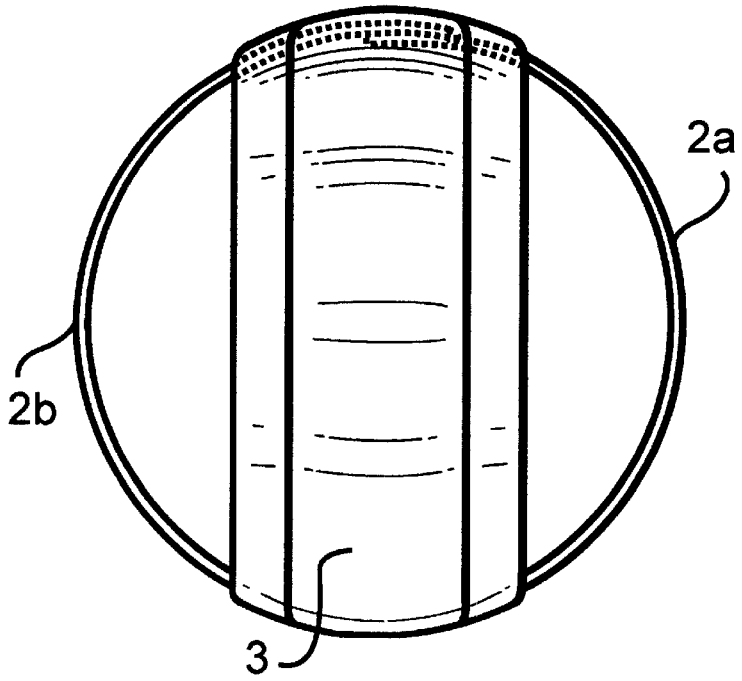
FIG. 9 shows the bottom view of the present invention in the engaged mode.
Figure 10:
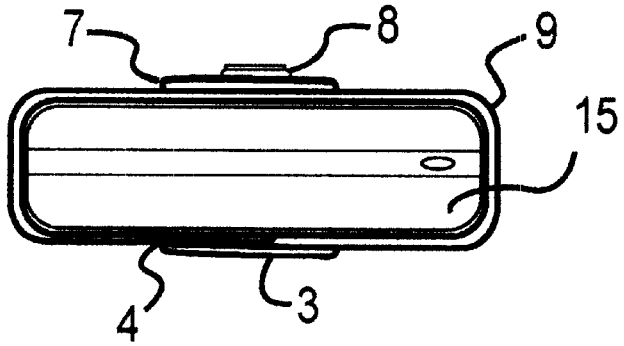
FIG. 10 shows the top view of the present invention carrying a cellular phone.
Figure 11:
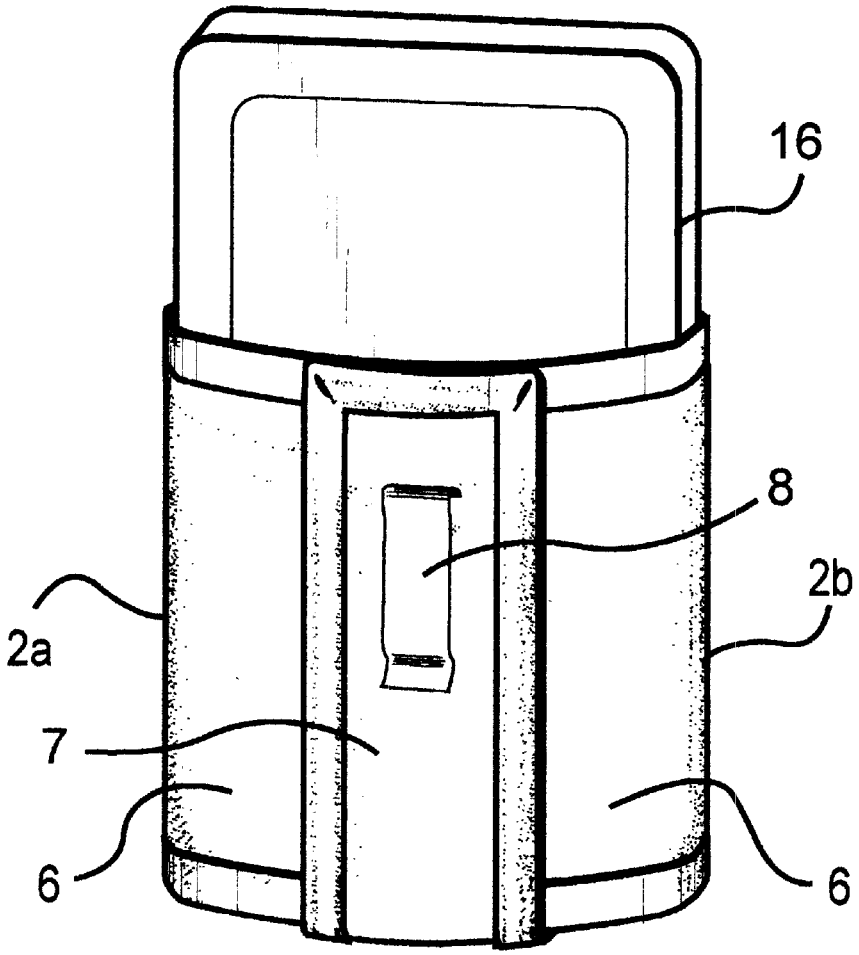
FIG. 11 shows the rear view of the present invention carrying a PDA.
Figure 12:
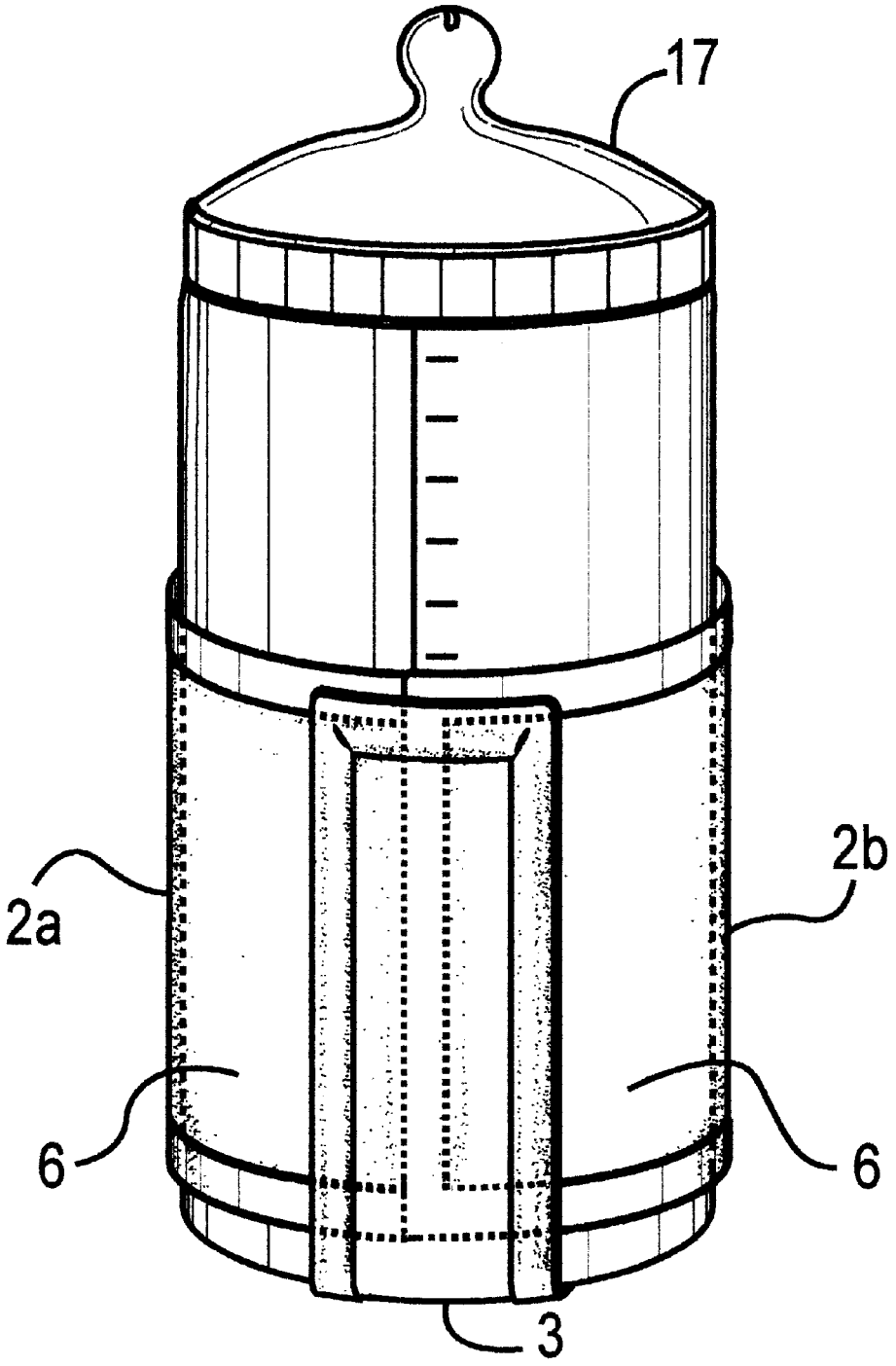
FIG. 12 shows the front view of the present invention carrying a baby bottle.
Figure 16:
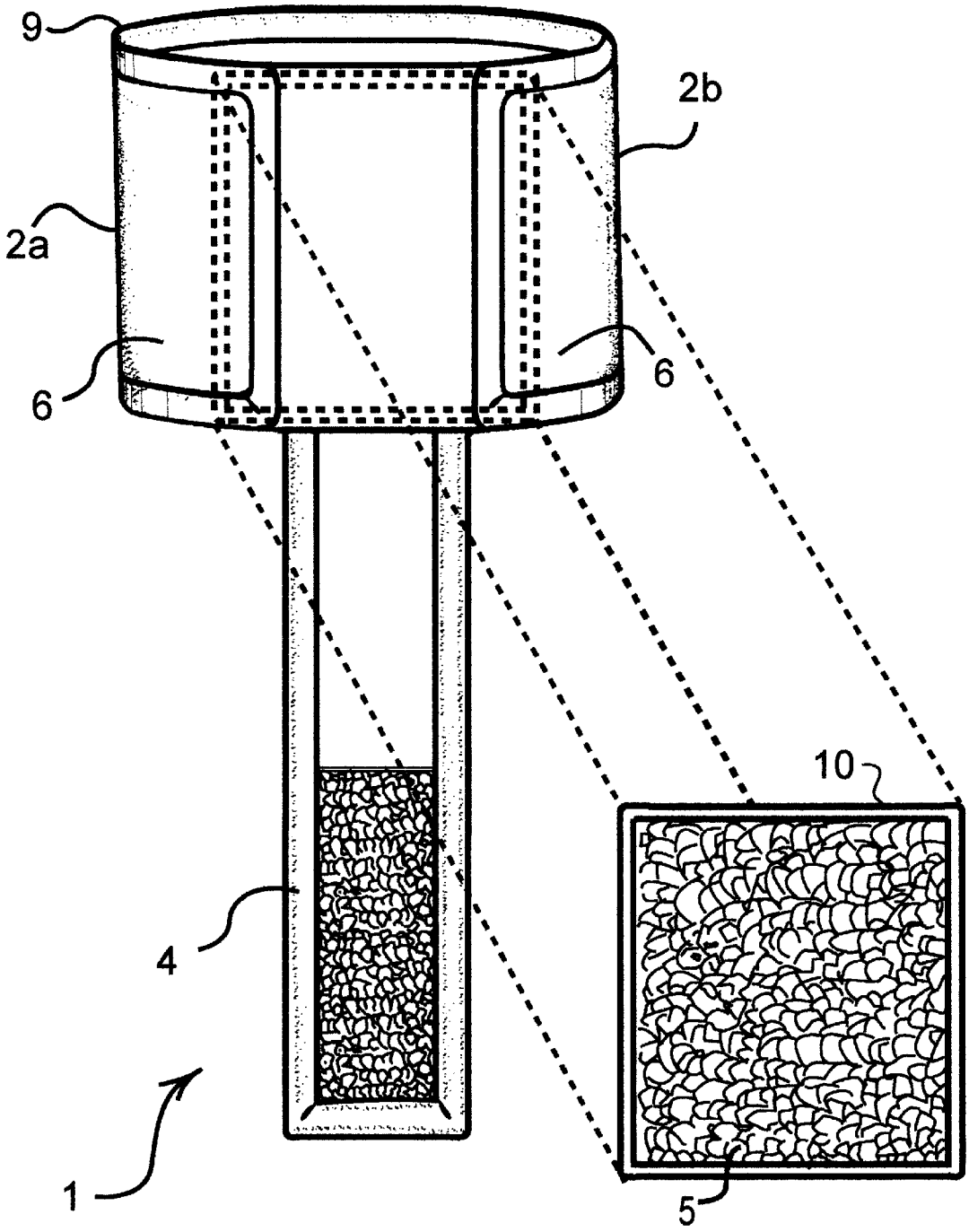
FIG. 16 shows the front view of the present invention partially engaged with the CEP on the outside.
Figure 17:
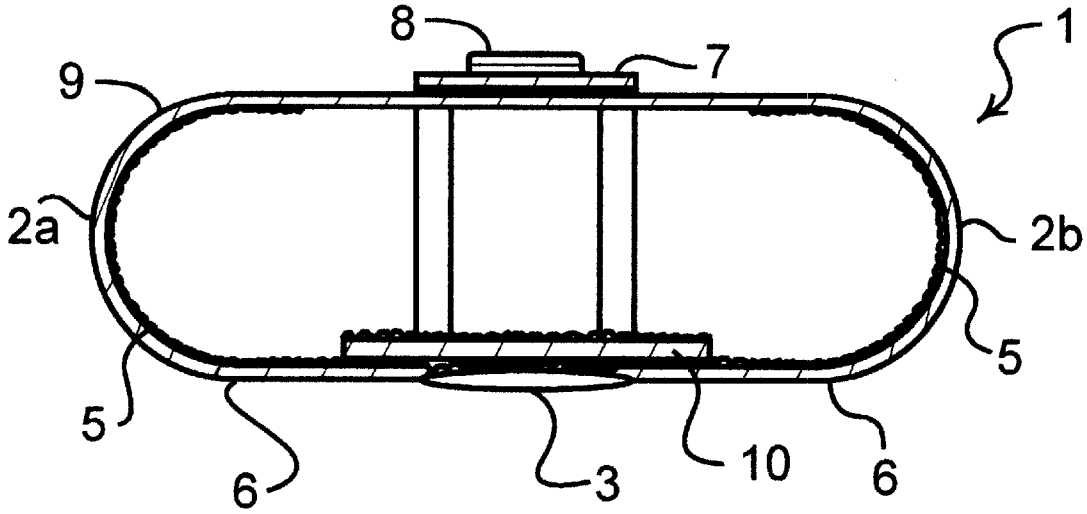
FIG. 17 shows the top view of the present invention in the engaged mode with the CEP installed on the inside.
Figure 18:
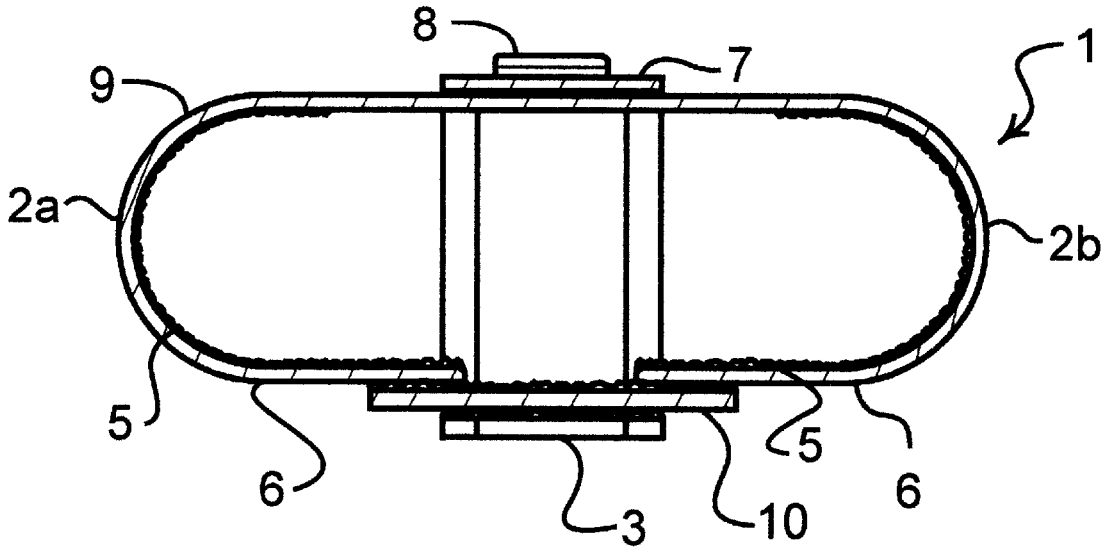
FIG. 18 shows the bottom view of the present invention in the engaged mode with the Capacity Extension Pad installed on the outside.

A preferred embodiment of the Multipurpose Adjustable, Portable Carry Pouch of the present invention is illustrated in FIGS. 1 through FIG. 18. FIG. 1 illustrates that this embodiment is comprised of a felt-laminated ballistic nylon material fabricated into a single piece, (1) with a Horizontal Segment (2) and a Vertical Segment (3). The Horizontal Segment measures 12"×4" and is divided into three equal 4"×4" sections having one Retention Flap on each of the opposing sides **(2*a*) and (2*b*) and a Central Segment (2*c*). In one embodiment the Retention Flaps are layered on the inside FIG. 1 (front view preacquisition mode) with a 4"×4" fillets of the loop component of a hook and loop faistening system (4). The Vertical Tongue Segment measures 8"×2" and is layered from the bottom edge through four inches up with a 4"×2" fillet of the hook component from a hook and loop fastening system (5). In FIG. 2 it is demonstrated that the Horizontal Segment Retention Flaps are layered with 4"×4" fillets of the hook components of a hook and loop fastening system (8). A Belt Loop (6) is affixed to the center section of the Horizontal Segment either by riveting or stitching and a Belt Clip (7) is attached to the Belt Loop. The borders of the present invention (1) are edged with gross grain ribbon (9) which, is stitched on. FIG. 3 shows the bottom front view of the present disclosure with belt a (11) threaded through Belt Loop (6). FIG. 4 illustrates the bottom front view of the present invention in the partially engaged mode demonstrating the pre-acquisition mode in phantom and the partially engaged mode with a thermos (12) in place. The arrows in FIG. 5 reveal the side view of the present invention shuttling from the pre-acquisition to the fully engaged modes. FIG. 6 illustrates the elevational front view of the present invention in the fully engaged mode clipped onto a belt (13). FIG. 7 shows the bottom front view of the present invention carrying a water bottle (14). FIG. 8 shows the top view of the present invention in the engaged mode. FIG. 9 shows the bottom view of the present invention in the engaged mode. FIG. 10 shows the top view of the present invention carrying a cellular phone (15). FIG. 11 shows the rear view of the present invention carrying a PDA (16). FIG. 12 shows the front view of the present invention carrying a baby bottle (17). FIG. 13 shows the hook side view of the Capacity Extension Pad (10). FIG. 14 shows the loop side view of the Capacity Extension Pad (10). FIG. 15 shows the side view of the Capacity Extension Pad (10). FIG. 16 shows the front view of the present invention partially engaged with the Capacity Extension Pad installed. FIG. 17 shows the top view of the present invention in the engaged mode with the Capacity Extension Pad installed on the inside. FIG. 18** shows the bottom view of the present invention in the engaged mode with the Capacity Extension Pad installed on the outside.

FIGS. 19–25—Alternative Embodiment

Figure 19:
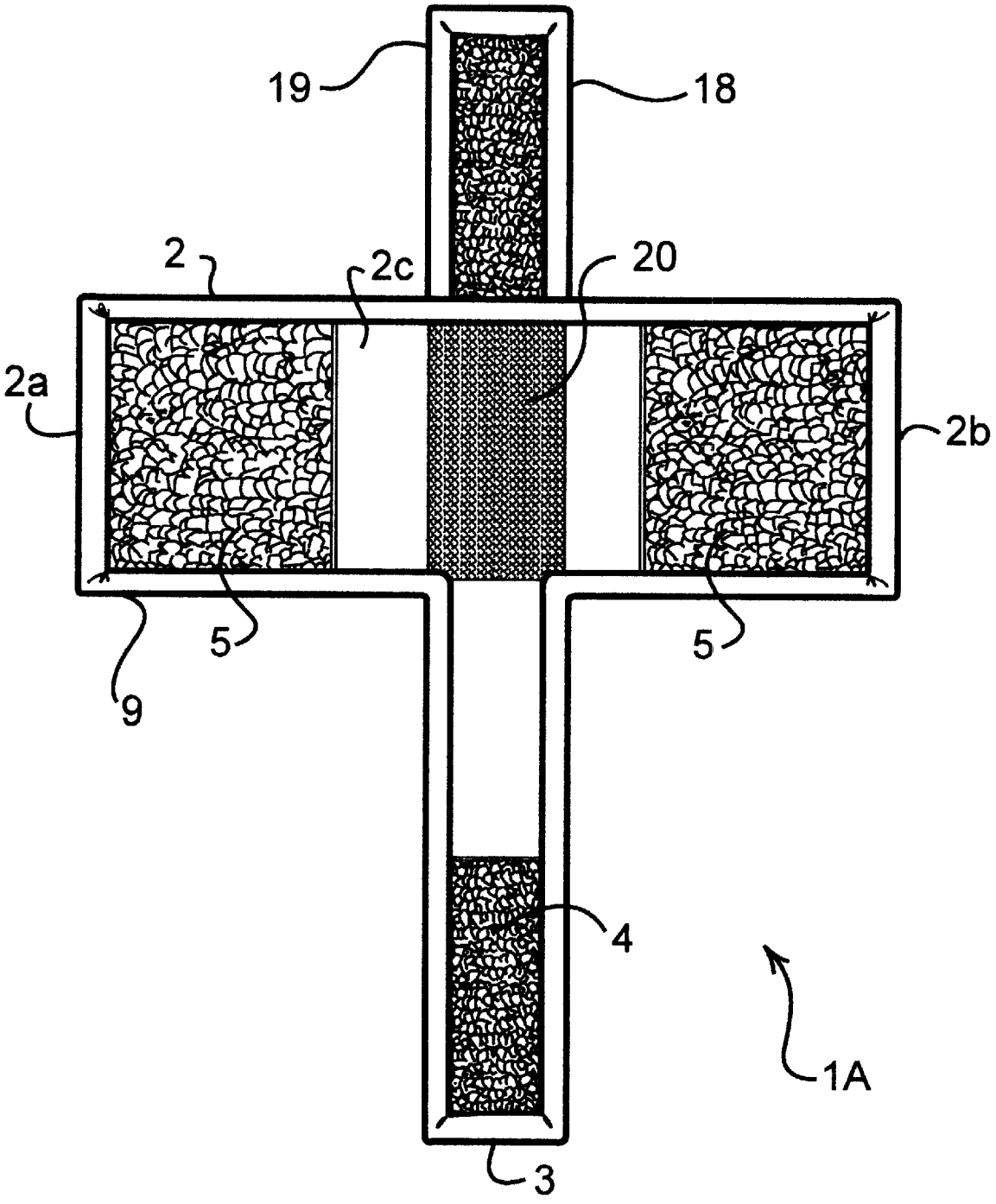
FIG. 19 shows the inside surface view of the belt loop extension wing alternative embodiment of the present invention.
Figure 20:
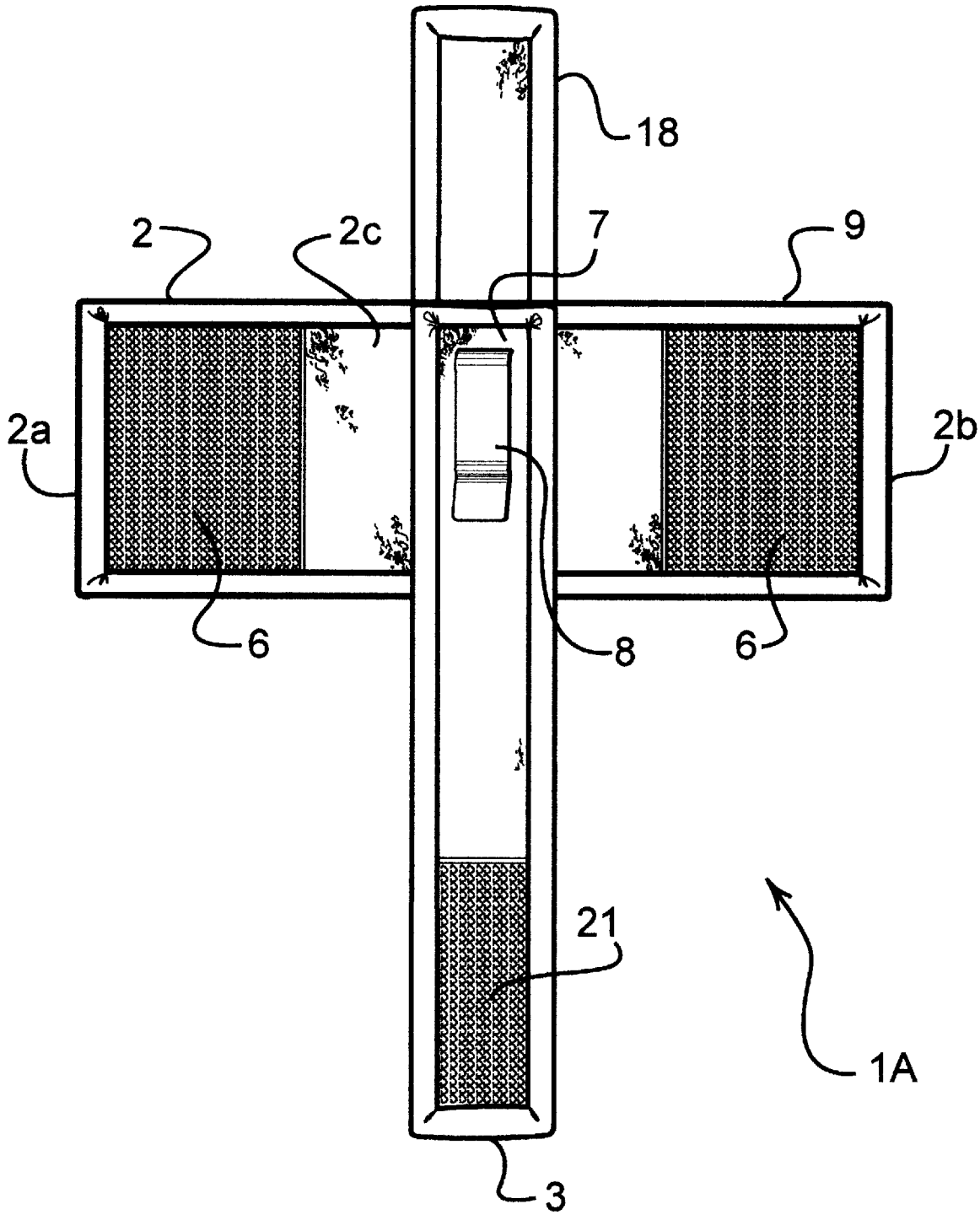
FIG. 20 shows the outside surface view of the belt loop extension wing alternative embodiment of the present invention.
Figure 21:
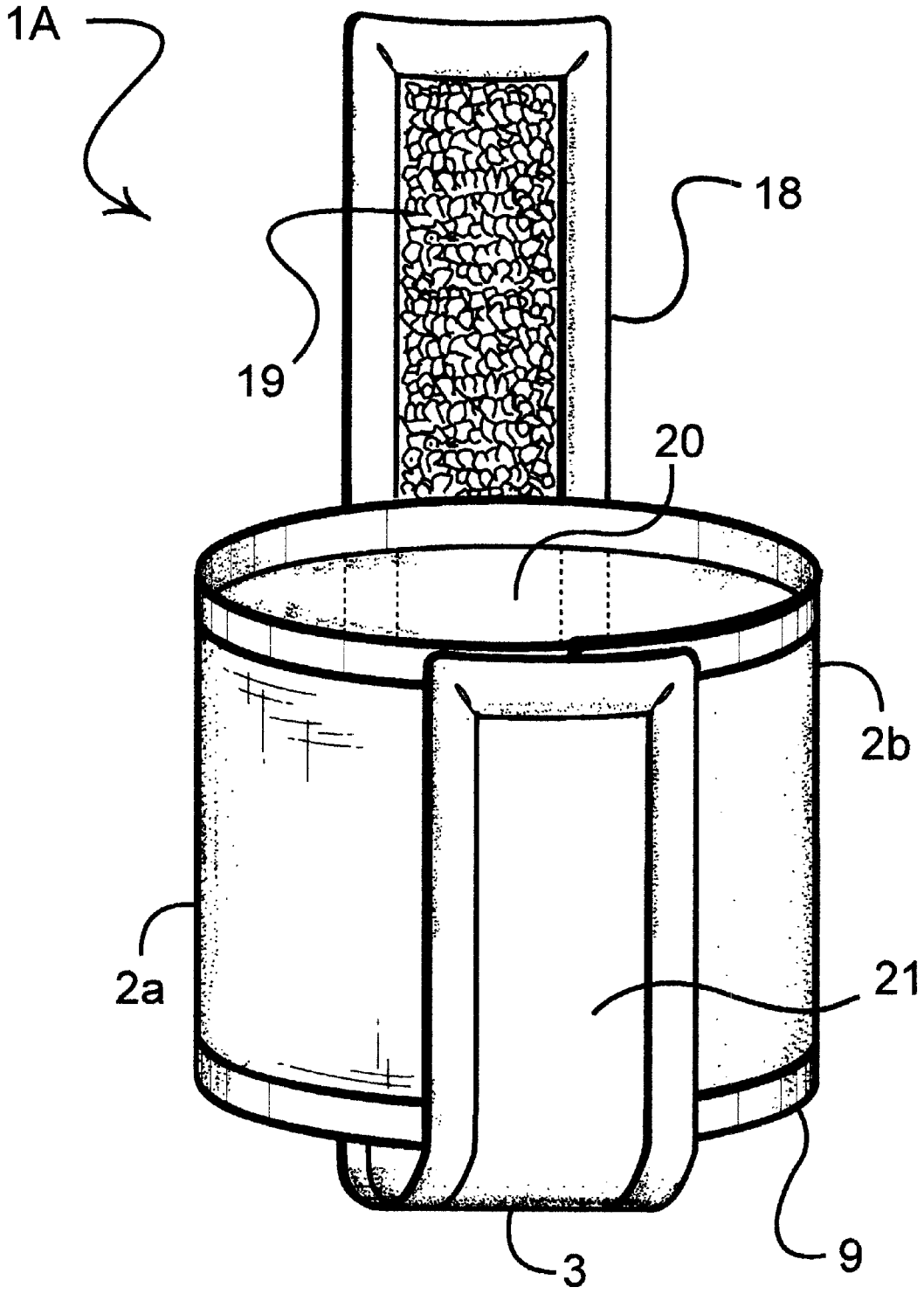
FIG. 21 shows the top front view of the belt loop extension wing alternative embodiment of the present invention.
Figure 22:
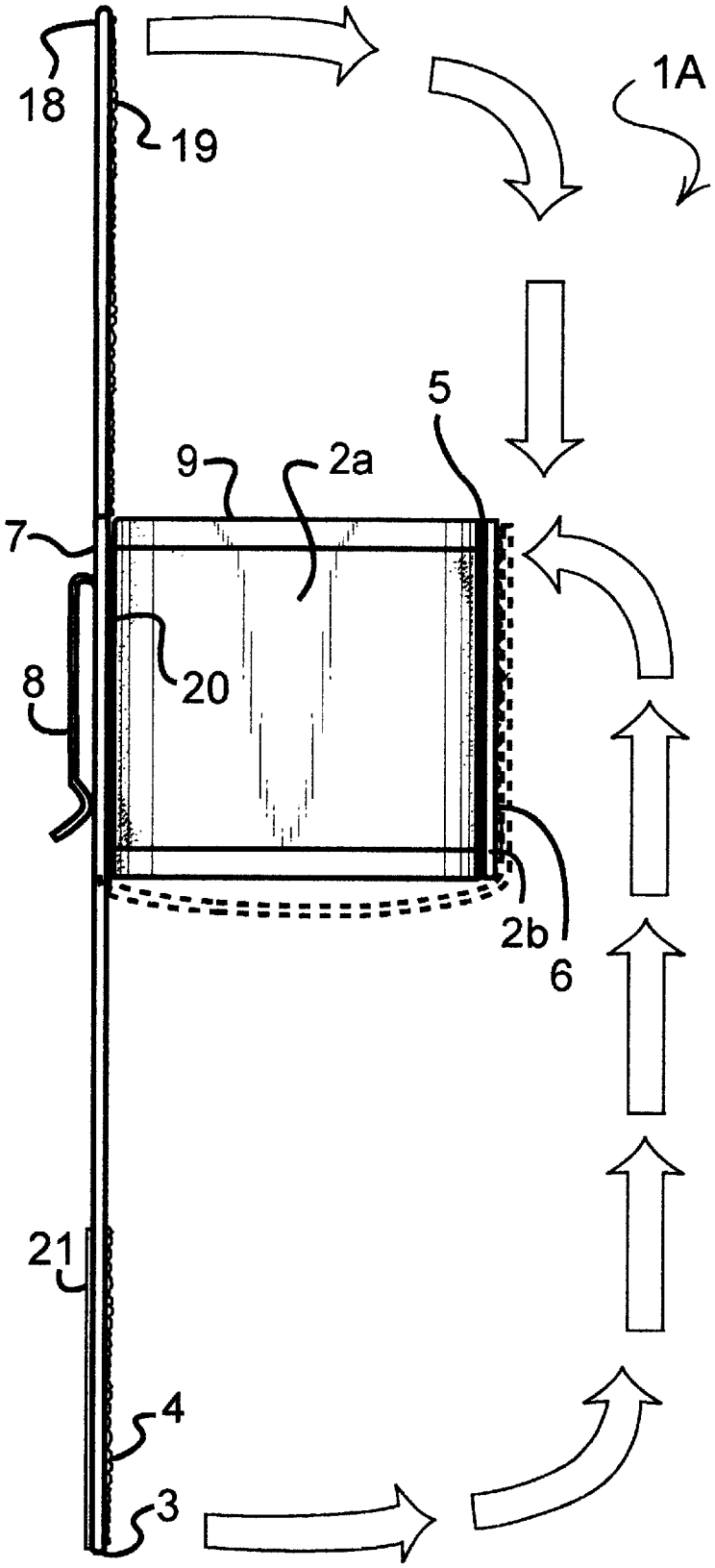
FIG. 22 shows the side view of the belt loop extension wing alternative embodiment of the present invention from the acquisition to the engaged mode.
Figure 23:
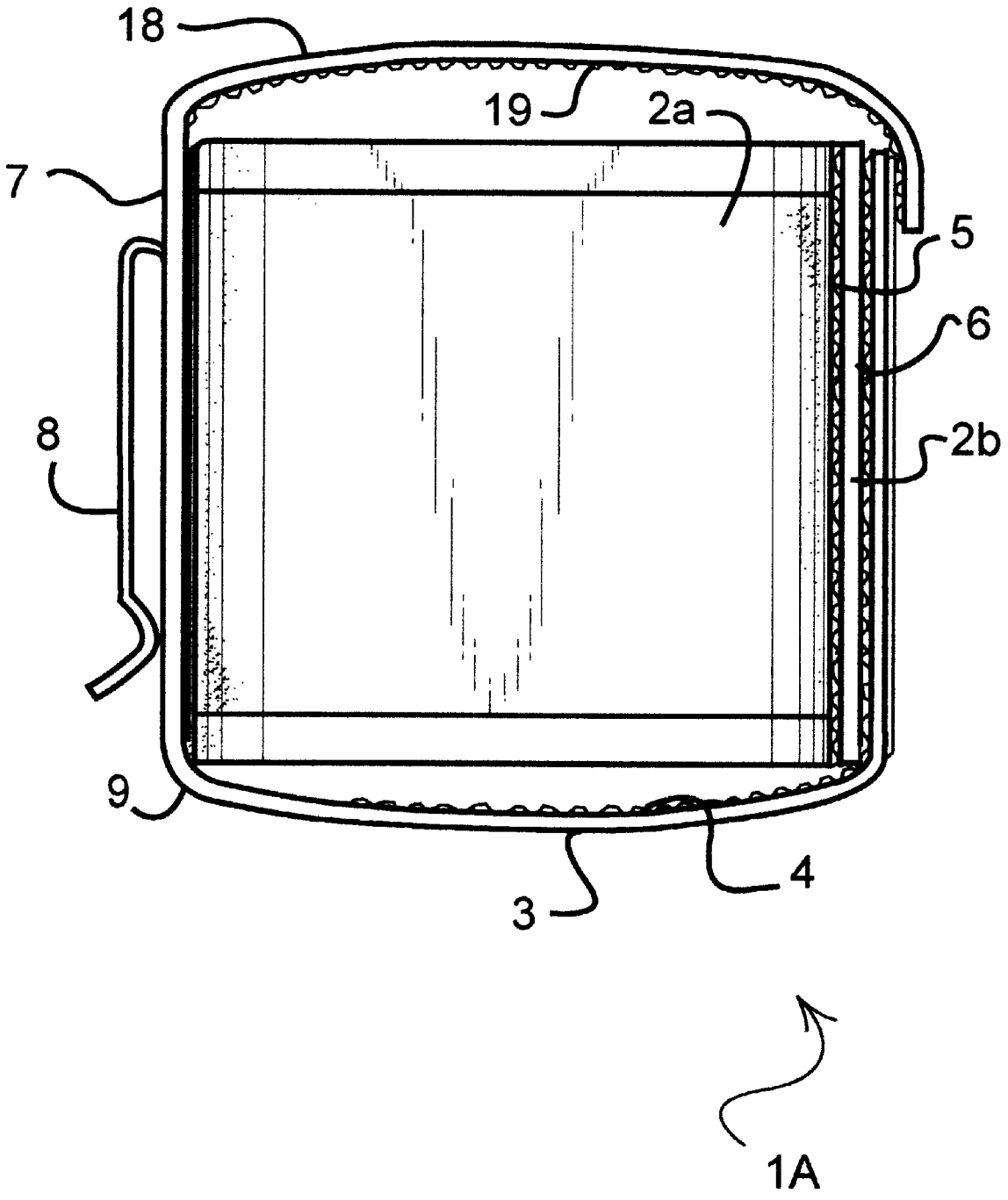
FIG. 23 shows the side view of the belt loop extension wing alternative embodiment of the present invention in the fully engaged mode.
Figure 24:
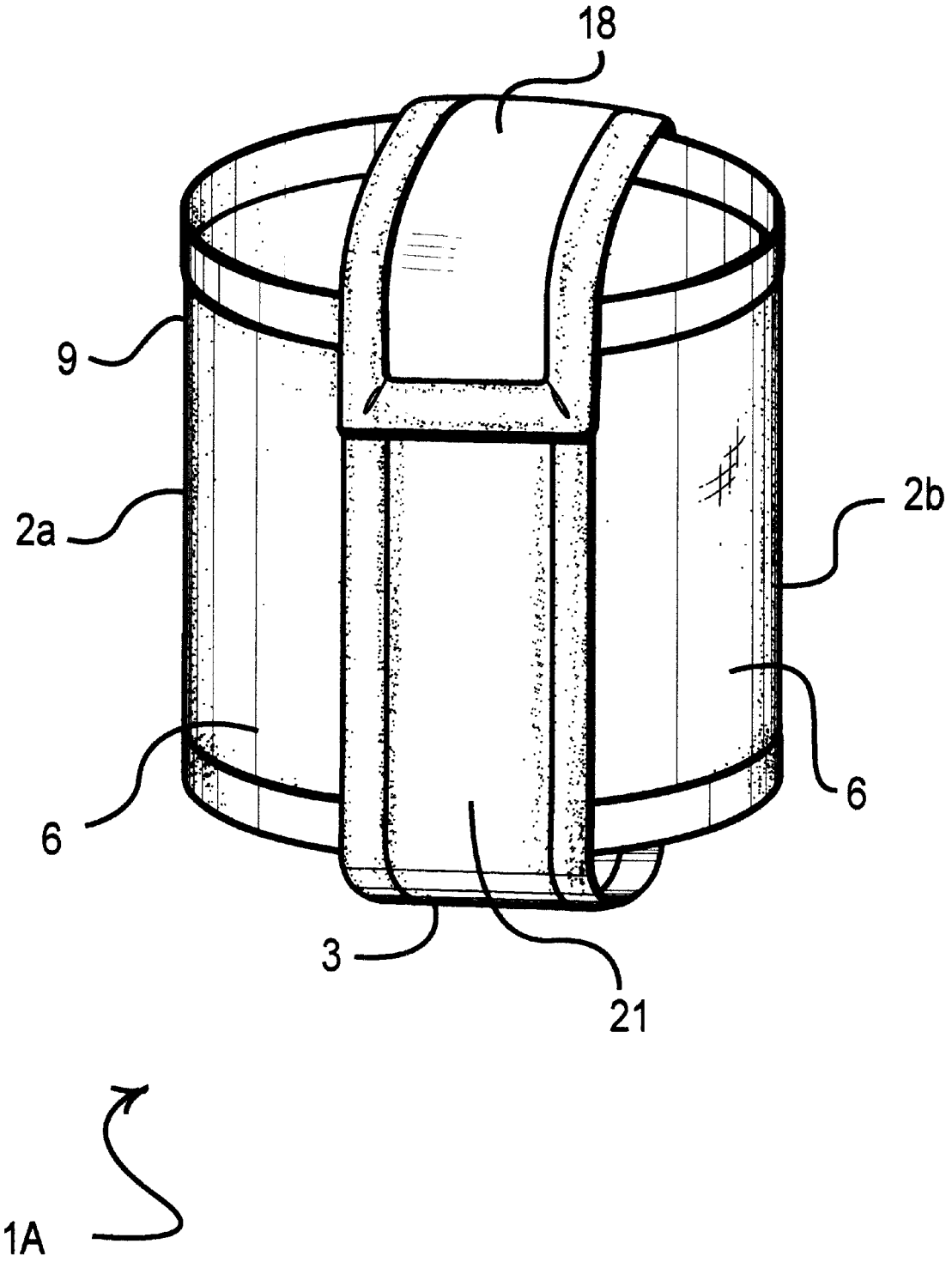
FIG. 24 shows the top-front view of the belt loop extension wing alternative embodiment of the present invention in the fully engaged mode.
Figure 25:
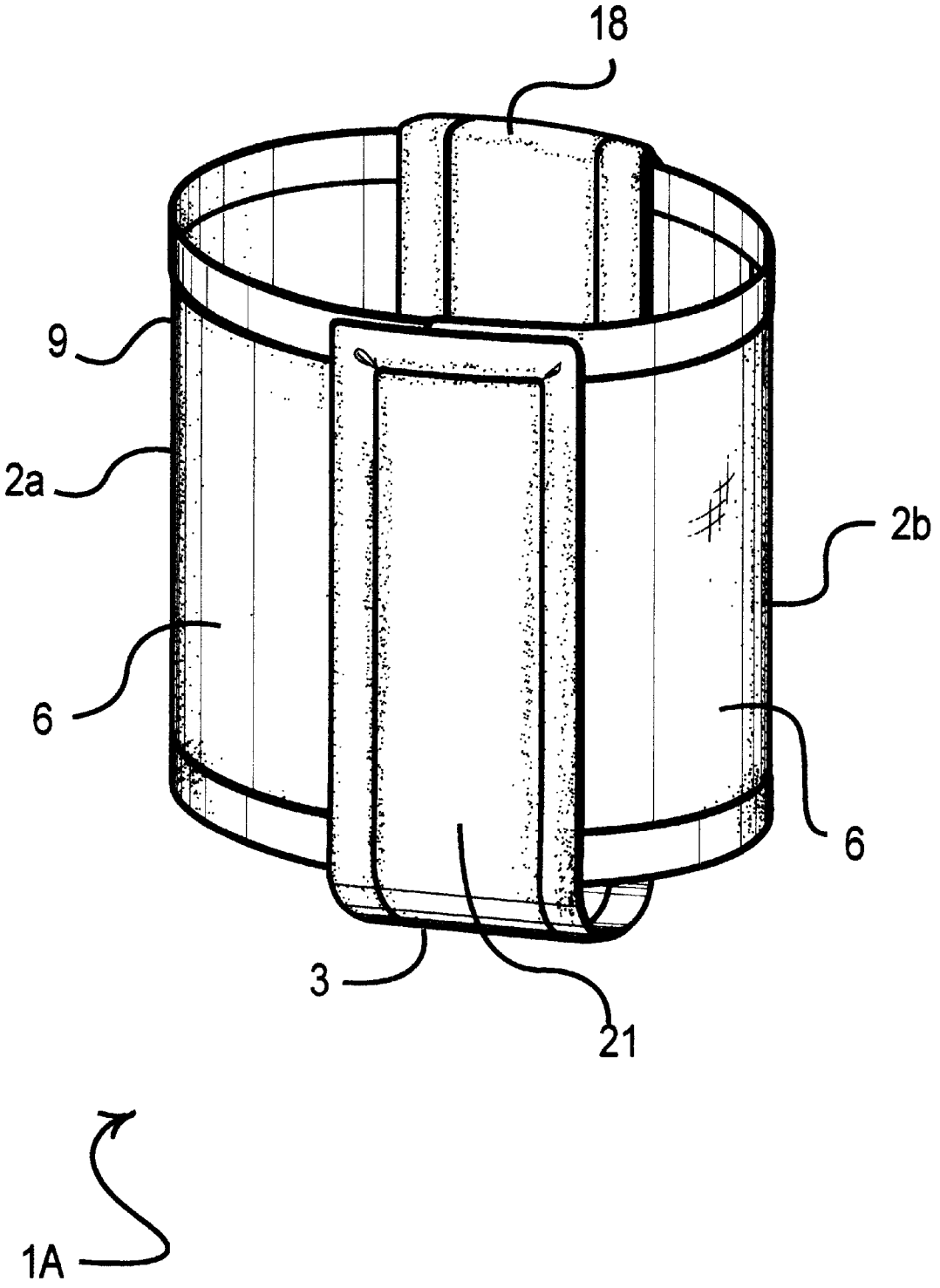
FIG. 25 shows the top-front view of the belt loop extension wing alternative embodiment of the present invention with the belt loop extension wing in the storage mode.

An alternative embodiment of the Multipurpose Adjustable, Portable Carry Pouch is illustrated in FIGS. 19 through 25. FIG. 19 shows that an alternative embodiment of the present invention (1A) is comprised of the preferred embodiment with the addition of a belt loop extension wing (18) made of ballistic nylon laminated with a soft-brushed cotton polyester lining. The central inside surface is layered with a 2"×4" rectangular fillet of the loop component of a hook and loop fastening system (19). Further, the inside surface of the belt loop extension wing is layered with a 2"×4" rectangular fillet of the hook component of a hook and loop fastening system FIG. 19. shows the inside surface view of the belt loop extension wing alternative embodiment of the present invention. FIG. 20 shows the outside surface view of the belt loop extension wing alternative embodiment of the present invention wherein the outside surface of the vertical tongue segment is layered with a 2"×4" fillet of the hoop component of a hook and loop fastening system. FIG. 21 shows the top front view of the alternative embodiment of the present invention with the belt loop extension wing (18) in acquisition mode. FIG. 22 shows the side view of the alternative embodiment of the present invention with the belt loop extension wing (18) and the vertical tongue segment (3) from the acquisition to the engaged mode. The hook component on the extension wing would then be mated with the loop component on the end of the vertical tongue segment to form a pellicle to cover and additionally secure smaller articles such as a wallet, sunglasses, eyeglasses and the like. If a longer article needs to be accommodated then the vertical tongue segment is adjusted to a lower position on its corresponding retention and the hook component on the extension loop can be mated to the loop component on the exposed retention flap. FIG. 23 shows the side view of the alternative embodiment of the present invention in the fully engaged mode. FIG. 24 shows the top-front view of the alternative embodiment of the present invention in the fully engaged mode. FIG. 25 shows the top-front view of the alternative embodiment of the present invention with the belt loop extension wing in the storage mode where the belt loop extension wing (18) is folded and mated to the 2"×4" rectangular fillet of the loop component of a hook and loop fastening system (21) on the inside central segment.

Additional Embodiments

Additional embodiments can be crafted of other materials such as denim and can be produced in varied dimensions for carrying very small items or much larger items.

Operation

The process of adjusting the present disclosure for a specific article can be accomplished with the multipurpose, adjustable, portable carry pouch being worn on one's person or not. The item to be carried is placed in the Inside Central Section FIG. 1 **(2*c*). Retention Flap (2*a*) is overlaid and wrapped compactly around the item causing the hook component of the hook and loop system to face inwards and exposing the loop component side of the Retention Flap (2*a*). The two overlapping Retention Flaps are mated by securing the exposed loop component on the outside of Retention Flap (2*b*) onto the exposed hook component on the inside of Retention Flap (2*a*) as shown in FIGS. 3 and 4. Slide object to the most stable or comfortable position desired. Rotate and attach the hook component on the inside of the Vertical Tongue Segment (3) to the exposed loop component FIG. 5 on (2*b*) at the desired length as shown in FIGS. 6 and 7. The above process can be performed by overlapping either of the Retention Flaps (2*a*) and (2*b*) over the other depending on the invention's placement or the dominant hand of the user. Also the operation can be performed whether the invention is off or on one's person. Further there is the option of threading a belt through the Belt Loop (7) or clipping the invention on to a belt, waistband or any convenient part of one's clothing using the Belt Clip (8)**.

CONCLUSION, RAMIFICATIONS AND SCOPE

Accordingly, the reader will see that the Multipurpose, Adjustable, Portable Carry Pouch and its embodiments can be simply and inexpensively manufactured and is easy to use. Further that the design of this invention permits it to be adjustable so as to securely, comfortably and conveniently accommodate a far wider variety of articles than any of the prior disclosures. This holding capability includes the full range of baby bottles as well as a wide variety of other designated objects. Also that the present disclosure can be easily secured to varied parts of the user's clothing so as to provide a non-intrusive holder for a baby bottle while caring for a newborn, infant or toddler without compromising due attention to the child or comfort to the user. Up until now this option has not been available to parents or caregivers.

What is claimed is:

1. A multipurpose, adjustable, portable carry pouch comprising:

(a) a horizontal textile member having inner and outer surfaces, a central segment and first and second retention flaps disposed on either side of said central segment;

(b) first and second loop fastening members secured to each of said retention flaps on the outside surface of said horizontal textile member;

(c) a vertical textile member having inner and outer surfaces being secured to the outer surface of the central segment of said horizontal textile member at an end thereof;

(d) a first hook fastening member secured to the inner surface of at least one said retention flaps in opposition to said first looped fastening member, said first hook fastening member being adapted to be adjustably coupled to and along said second looped fastening member;

(e) a second hook fastening member being secured to the inner surface of said vertical textile member in opposition to said horizontal textile member, said second hook fastening member being adapted to be adjustably coupled to and along said first looped fastening member;

(f) a belt loop coupled to the outer surface of said horizontal textile member at the central segment thereof in alignment with said vertical textile member; and (g) a belt clip secured to said belt loop.

* * * * *